US006073288A

United States Patent [19]

Berenstein

[11] Patent Number: 6,073,288

[45] Date of Patent: Jun. 13, 2000

[54] TRAINING PILLOW

[76] Inventor: Barry M. Berenstein, 2 Forest Laneway, Apartment 2203, Toronto, Ontario, Canada, M2N 5X7

[21] Appl. No.: 09/244,890

[22] Filed: Feb. 5, 1999

[51] Int. Cl.[7] ..... A47G 9/02

[52] U.S. Cl. ..... 5/636; 5/643; 5/490

[58] Field of Search ..... 5/636, 637, 639, 5/643, 490

[56] References Cited

U.S. PATENT DOCUMENTS

| | | | |
|---|---|---|---|
| D. 349,475 | 8/1994 | Mocur . | |
| 1,385,355 | 6/1921 | Banks . | |
| 2,700,779 | 2/1955 | Tolkowsky . | |
| 2,940,087 | 6/1960 | Kiefer . | |
| 3,139,631 | 7/1964 | Kiefer | 5/636 X |
| 3,243,828 | 4/1966 | McCarty | 5/636 |
| 3,763,509 | 10/1973 | Mittendorf | 5/643 X |
| 3,829,917 | 8/1974 | De Laittre et al. | 5/636 |
| 3,879,775 | 4/1975 | Iwata | 5/639 |
| 4,031,578 | 6/1977 | Sweeney et al. . | |
| 4,850,068 | 7/1989 | Walpin et al. . | |
| 4,896,388 | 1/1990 | Bard . | |
| 4,947,931 | 8/1990 | Vitacco . | |
| 5,182,828 | 2/1993 | Alivizatos . | |
| 5,467,782 | 11/1995 | Wiseman | 5/636 |
| 5,544,378 | 8/1996 | Chow . | |

OTHER PUBLICATIONS

Brochure for "The Align–Right Pillow" The Align–Right Pillow Company Ltd., 1996.

Prevention, "Choosing The Best Pillows For Pain Relief" Mar. 1991, pp. 53–127.

Brochure for "Independent Needs Centre" Date Unknown.

Brochure for "The Orthopedic Support Pillow" Knight Comfort, Jun. 6, 1994.

Brochure for "Comfort Products", Date Unknown.

Brochure for"Orthopedic Pillows" Shop Maxi–Aids, Date Unknown.

Brochure for "The Back Store" J.A. Preston of Canada Limited, 1985.

Brochure for "Hedonics", 1997.

*Primary Examiner*—Michael F. Trettel

*Attorney, Agent, or Firm*—Gowling, Strathy & Henderson; Arne I. Fors; Robert J. Graham

[57] ABSTRACT

A training pillow to assist in teaching a person not to sleep face-down has base a portion for supporting the back of the head when lying face-up on a sleeping surface and two side portions which project substantially diagonally from the base portion and away from the sleeping surface. The pillow can make it awkward and/or uncomfortable for the person to sleep face-down and thereby arousing the person into a conscious state to remind the person not to sleep face-down. Additionally, flipping the pillow over will present an awkward and/or uncomfortable sleeping surface. However, when a person rolls to the side, the corresponding side of the person's head causes the appropriate side portion to move into contact with the sleeping surface, while the base portion and the opposite side portion are lifted away from the sleeping surface.

15 Claims, 5 Drawing Sheets

TRAINING PILLOW

FIELD OF THE INVENTION

This invention relates to pillows and more particularly relates to a training pillow for training persons not to sleep face-down and thereby reduce neck and/or back pain.

BACKGROUND OF THE INVENTION

Back and neck pain is a significant problem for many people, and several types of therapeutic pillows have been developed to help relieve this pain. One type of pillow provides improved cervical support by having an indentation to receive the head and a bulbous portion to support the neck. One general principle behind these pillows is to provide a comfortable sleeping surface for the head, while providing cervical support for the neck, thereby reducing muscle tension in the neck. For example the Mediflow® pillow, U.S. Pat. Nos. 4,947,931 and 4,896,388, has a soft-fibre upper layer and a water-filled bag lower layer. In use, the pillow adapts to the contours of the head and neck thereby providing appropriate head and neck support.

The foregoing prior art is useful for relieving back and neck pain, however, it has been found that a contributing factor to back and/or neck pain is poor sleeping habits. One poor sleeping habit is the tendency for some people to sleep face-down, rather than on their side and/or on their back. For greater clarity, as used herein the term "face-down" refers to a person sleeping with his or her front-side down, wherein the person's chest and stomach are lying on the sleeping surface and typically the person's head is twisted to one side. As is known to those of skill in the art, sleeping face-down can place stress on certain muscles and cause particular strain in the back and/or neck. After sleeping face-down, persons can awake and find themselves sore and stiff. Persons who have chronic pain can find themselves in even greater discomfort after sleeping face-down. One problem with the prior art is that persons who habitually sleep face-down can simply sleep face-down on the pillow or unconsciously discard or flip the pillow over to use the flat side of the pillow, such that it is relatively comfortable for sleeping face-down.

In contrast to the foregoing, the Materna-mate® pillow, as found in U.S. Design Pat. No. 298,715, supports a pregnant woman lying on her side or on her back, but makes it difficult for her to sleep on her front. The Materna-mate® is characterized by a flat bottom and a concave upper portion, defined by a thin central portion and a pair of wedge-shaped side portions which slope downwardly towards the central portion. The pillow can be used about the waist area of the pregnant woman to provide support about the middle and lower back. The pillow can assist keeping a pregnant woman more comfortable during sleeping and sitting. It will be apparent, however, that the Materna-mate® does not provide head and neck support and is best suited to the unique needs of a pregnant woman, and is generally unsuitable for training a person not to sleep face-down.

It will be apparent from the foregoing that prior art pillows are generally designed to relieve back and neck stress and provide support, but are generally unsuitable for training a person to sleep on his or her back and/or side.

SUMMARY OF THE INVENTION

It is an object of the present invention to provide a novel training pillow to help teach a person not to sleep face-down and which obviates or mitigates at least one of the disadvantages of the prior art. In a first embodiment of the present invention, there is provided a training pillow for assisting in teaching a person not to sleep face-down, comprising: a medial base portion for supporting a back of the person's head above a surface when the pillow is in a resting position, the base portion having opposite ends; and a side portion projecting substantially diagonally from each of the opposite ends of the base portion and away from the surface, such that when the person rolls to one side the pillow moves from the resting position to a raised position as a corresponding side portion supports a corresponding side of the person's head above the surface.

In a preferred aspect of the first embodiment, each of the side portions has an angle from about twenty degrees to about ninety degrees in relation to the base portion.

In a second preferred aspect, each of the side portions has an angle from about thirty degrees to about seventy-five degrees in relation to the base portion.

It is particularly preferred that each of the side portions has an equal angle of about fifty-seven degrees in relation to the base portion. However, it is contemplated that each of the side portions can have different angles in relation to the base portion.

In another preferred aspect of the first embodiment, the base portion has at least one fore or aft bulbous portion for supporting a nape of the person's neck adjacent the fore or aft portion, and a recessed portion for supporting the back of the person's head.

It is contemplated that the pillow of the present invention is particularly suited to help to train a child not to sleep face-down, and in order to assist teaching the child, it is contemplated that the pillow can have a configuration pleasing to the child in order to pique the child's interest in using the pillow. An example of one pleasing configuration is a butterfly.

In another preferred aspect of the invention, the pillow further includes a pillow-case having a configuration pleasing to the person.

In an alternative embodiment, there is provided a pillow-case for a training pillow for assisting in teaching a person not to sleep face-down, the pillow having a base portion with opposite ends for supporting a back of the person's head above a surface and two side portions projecting substantially diagonally from the opposite ends of the base portion and away from the surface, whereby when the person rolls to one side a corresponding side portion supports a corresponding side of the person's head above the surface, the pillow-case comprising: a first sleeve portion to receive a first side-portion; a second sleeve portion to receive the base portion; and a third sleeve portion to receive a second side-portion. It is contemplated that the pillow-case can have a configuration pleasing to person in order to pique the person's interest in the pillow-case to further assist in the training of the person not to sleep face-down.

BRIEF DESCRIPTION OF THE DRAWINGS

The present invention will now be described, by way of example only, with reference to certain embodiments shown in the attached Figures in which.

DETAILED DESCRIPTION OF THE DRAWINGS

Figure 1:
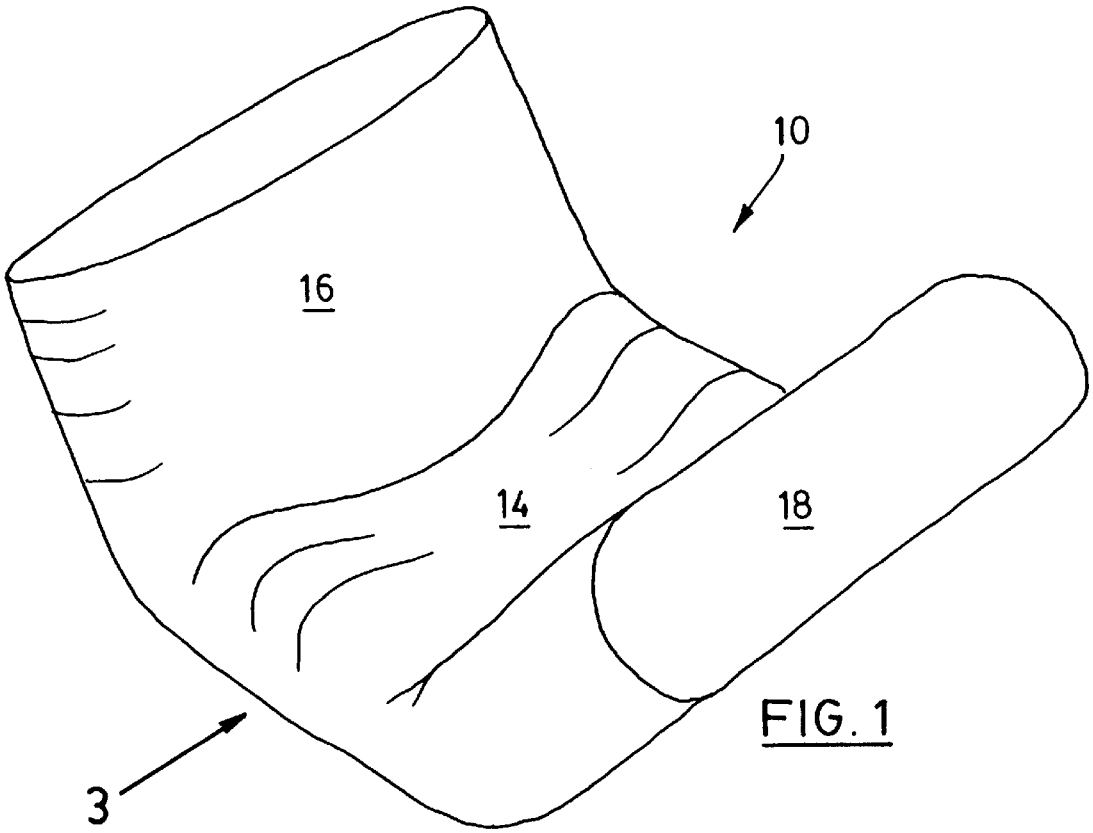
FIG. 1 is a perspective view of a training pillow in accordance with a first embodiment of the present invention.
Figure 2:
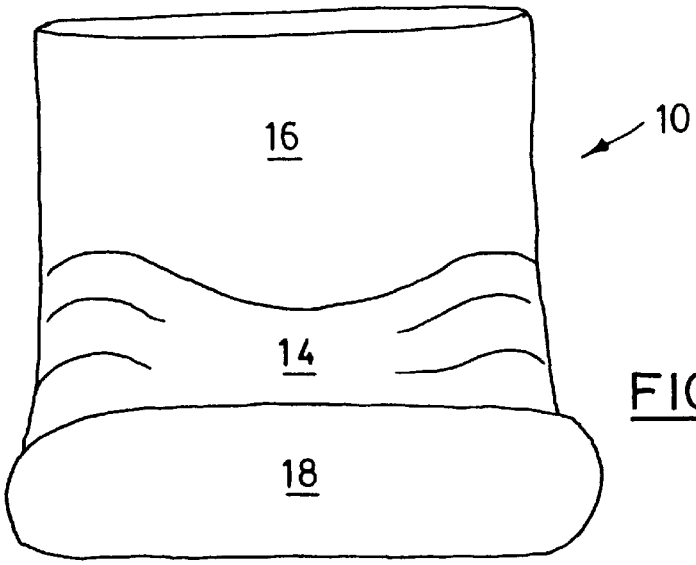
FIG. 2 is a side elevation view of the pillow shown in FIG. 1.

Referring to FIGS. 1–4, a training pillow in accordance with a first embodiment of the present invention is indicated generally at 10. Pillow 10 comprises a base portion 14, a first side portion 16 and a second side portion 18. Side portions 16, 18 each project substantially diagonally from opposite ends of base portion 14. As will be explained in greater detail below, the concave side of pillow 10 presents a comfortable resting area for a person's head, while the convex side preferably rests on a sleeping surface such as a bed. Pillow 10 has a resting position, best seen in FIGS. 1–4, wherein base portion 10 is in contact with the sleeping surface while side portions 16, 18 project away from the sleeping surface.

Figure 3:
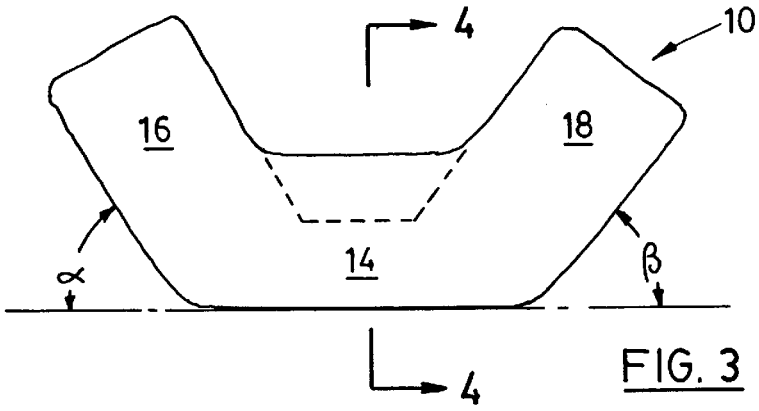
FIG. 3 is front elevation view of the pillow shown in FIG. 1.

Referring now to FIG. 3, it can be seen that side portion 16 has an angle of $\alpha$ in relation to base portion 14, and side portion 18 has an angle $\beta$ in relation to base portion 14. It is believed that $\alpha$ and $\beta$ can be in the range from about twenty degrees to about ninety degrees. Preferably, $\alpha$ and $\beta$ should be in the range of from about thirty degrees to about seventy-five degrees. However, it has been found that for the present embodiment an $\alpha$ of about fifty-seven degrees and $\beta$ of about fifty-seven degrees is optimal. It will be understood that other angles can be provided and that $\alpha$ need not be equal to $\beta$. Further a range of different pillows 10 having different angles and sizes can be provided to suit the needs of different individuals.

Side portions 16, 18 are generally parallelepiped shaped, but it will be understood by persons of skill in the art that side portions 16, 18 can have other generally planar shapes and configurations without departing from the scope of the present invention.

Figure 4:
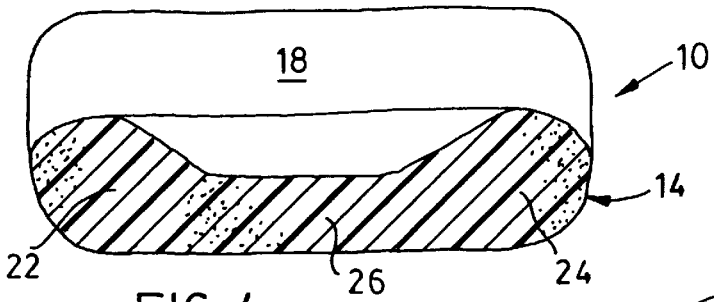
FIG. 4 is a sectional view, partly in elevation, through line 4—4 in FIG. 3.

As best seen in FIG. 4, in cross-section base portion 14 in generally characterized by aft and fore bulbous portions 22, 24 and a recessed portion 26. Bulbous portions 22, 24 are suitable for supporting the nape of the neck, while recessed portion 26 is suitable for supporting the back of the head. It is contemplated that bulbous portions 22, 24 can have different shapes and sizes in order to accommodate the needs of different persons or provide a range of comfort for a particular individual. It is to be understood, however, that base portion 14 can have other generally planar shapes, such as parallelepiped, without departing from the scope of the invention.

In the preferred embodiment, pillow 10 is a continuous mold made from a suitable foam-rubber or similar material that is comfortable for use as a pillow as will occur to those of skill in the art. Preferably, the density and rigidity of the material is high enough such that side portions 16, 18 remain at substantially the same angle $\alpha$, $\beta$ in relation to medial base portion 14 under a force slightly greater than the force of gravity, yet low enough not to compromise the comfort of pillow 10.

Figure 5:
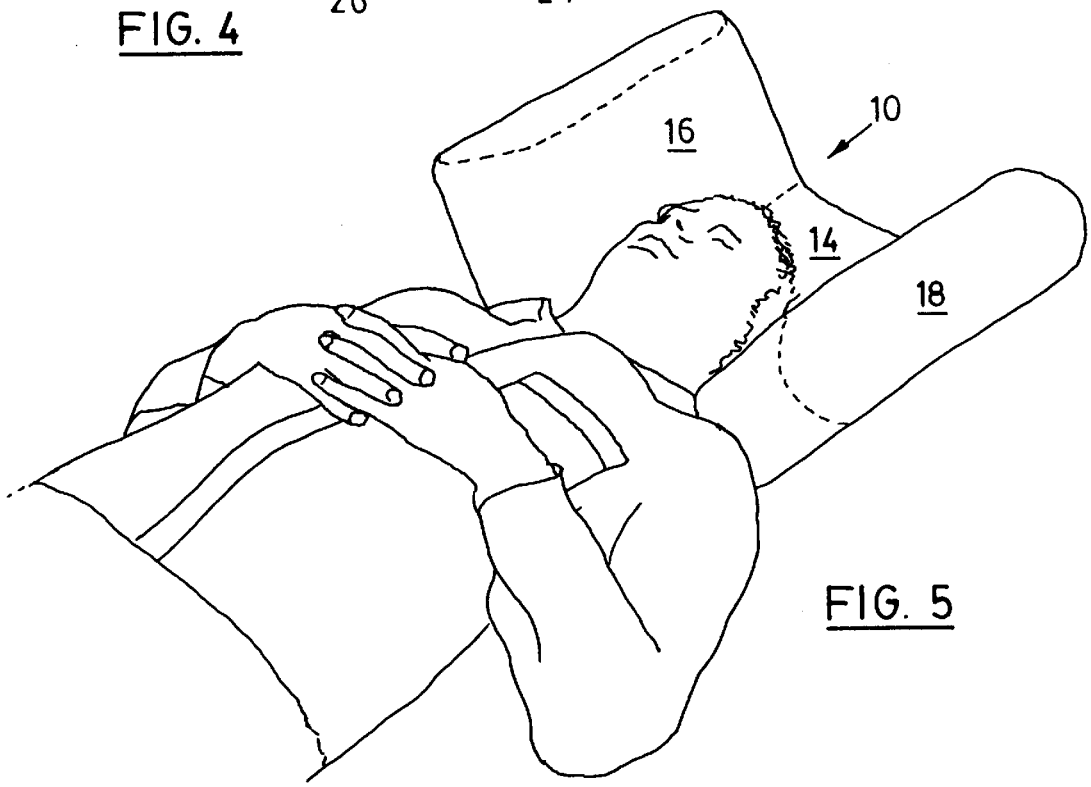
FIG. 5 is a perspective view of a person lying on his back on the pillow of FIG. 1.

The use of pillow 10 will now be explained with reference to FIGS. 5–7. Referring first to FIG. 5, pillow 10 is on a bed and is in the resting position such that base portion 14 is in contact with the surface of the bed and side portions 16, 18 project diagonally away from the bed. A person lies face-up with the back of the person's head resting on recessed portion 26 and the nape supported by bulbous portion 24. The person then falls asleep with his head supported above the surface. Optionally, the person can simply lean his cheek on the corresponding side portion 16, 18 while continuing to sleep on his back.

Figure 6:
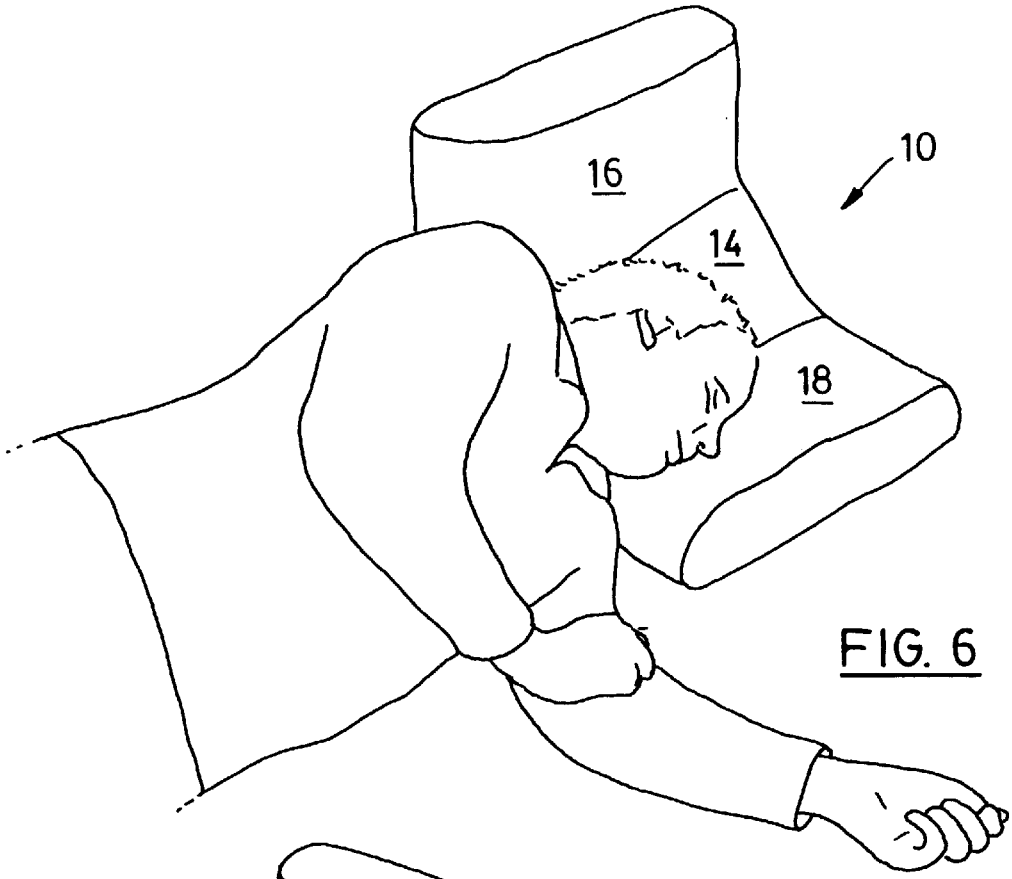
FIG. 6 is a perspective view of a person lying on his left side on the pillow of FIG. 1.

Referring now to FIG. 6, the sleeping person rolls on his left side such that the left side of the person's head makes contact with side portion 18. The weight and position of the side of the person's head directs side portion 18 downward towards the surface of the bed, and urges pillow 10 from the resting position into a first raised position as base portion 14 and side portion 16 move away from the surface of the bed. The person can sleep comfortably in this position as the person's head is supported by side portion 18 above the surface in generally the same relation to the surface as the resting position. Referring now to FIG. 7, the foregoing description is also applicable when the sleeping person rolls on his right side as the pillow moves from the resting position into a second raised position. When the person rolls onto his back, the pillow follows the movement of the person's head and moves from the raised position into the resting position.

Figure 7:
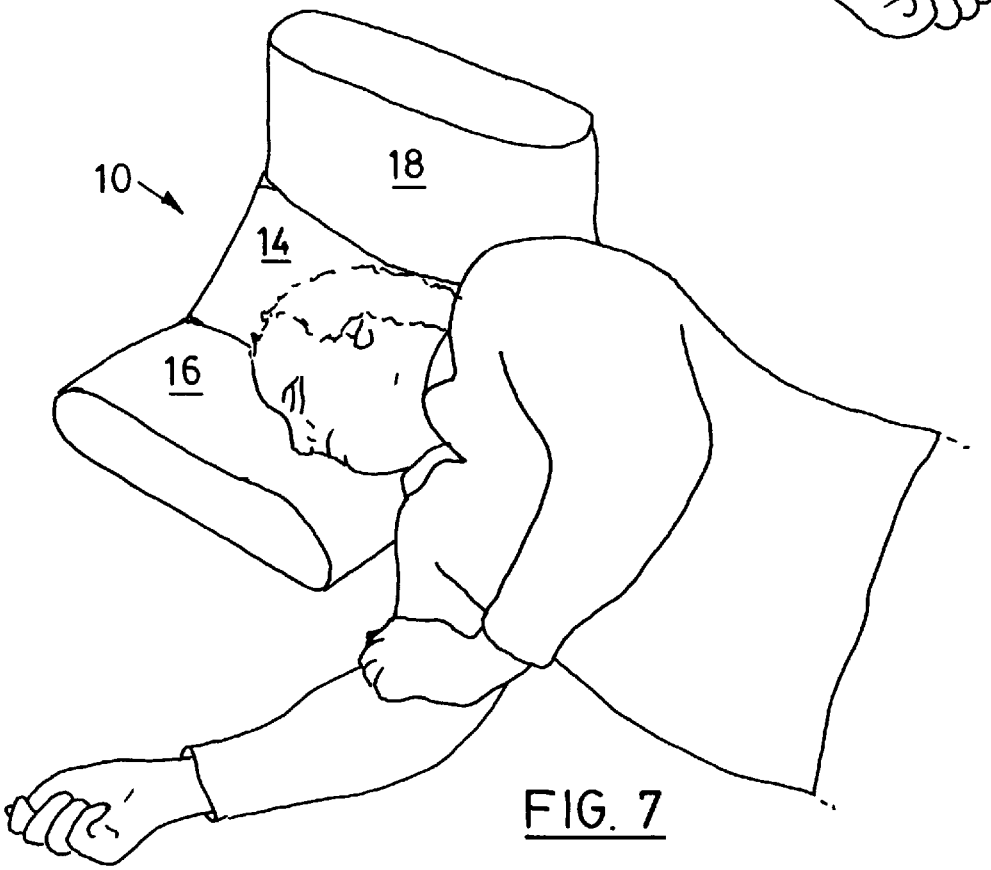
FIG. 7 is a perspective view of a person lying on his right side on the pillow of FIG. 1.

Should the person attempt to roll onto his front from any of the positions shown in FIGS. 5–7, the person will generally have to either remove the pillow or attempt to lie face-down into the concave side of the pillow which will be uncomfortable and/or awkward. It is also possible to flip the pillow, but this will present a convex surface which is also uncomfortable and/or awkward for sleeping. It has been found that such attempts to sleep on the person's front will generally be sufficiently uncomfortable and/or awkward so as to briefly awaken and/or arouse the consciousness of the person, thus allowing the person to consciously remember not to sleep face-down and thereby assisting in teaching the person to sleep on his back and/or side. It is believed that repeated use of the pillow can eventually condition a person not to sleep face-down without the need for training pillow 10.

While the foregoing description refers to use of the pillow 10 on a substantially horizontal surface, it is contemplated that pillow 10 can be used to support a person's head above an inclined surface, such as a hospital bed.

It will be apparent to those of skill in the art that the present invention can be of particular assistance in teaching children proper sleeping habits and thereby reduce neck and/or back pain for the child in his or her adult years. An appropriately sized pillow can be designed for a child's particular size, and with proper instruction, a child using the pillow can learn not to sleep face-down before adulthood and thereby reduce the likelihood of future back and/or neck problems.

Figure 8:
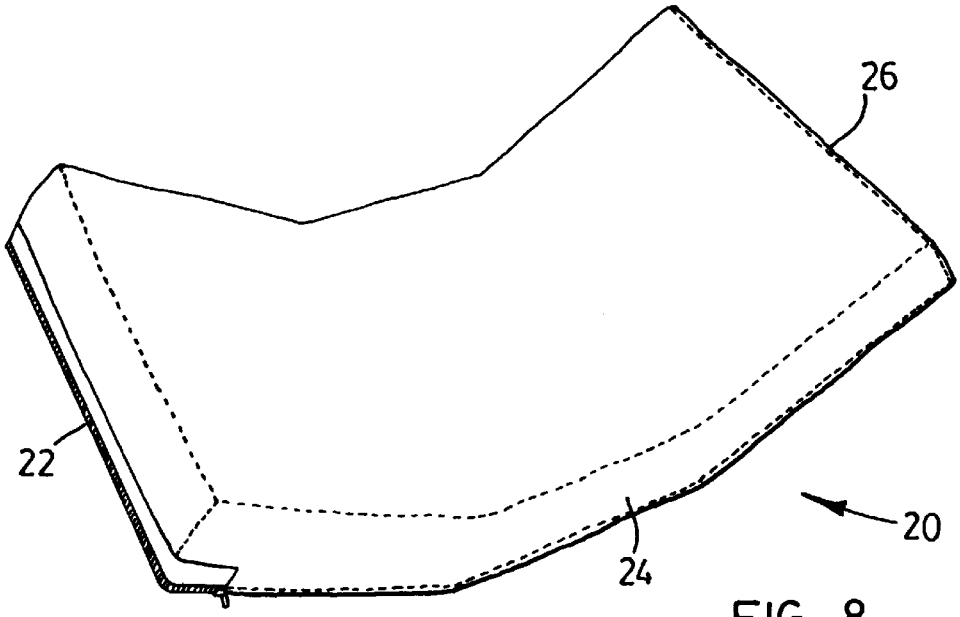
FIG. 8 is a perspective view of the pillow of FIG. 1 encased in a matching pillow case in accordance with another embodiment of the invention.

While certain embodiments of pillow 10 can be used with a conventional pillow case, it is contemplated that a special pillow-case specifically suited to pillow 10 can also be used. Referring now to FIG. 8, a specialized pillow-case 20 preferably comprises a first sleeve portion 22 to receive side-portion 16, a second sleeve portion 24 to receive base portion 14 and a third sleeve portion 26 to receive side-portion 18. Preferably, each sleeve portion is joined at a relative angle to each other that is complementary to the angles of the pillow. Each sleeve portion can be form-fitted to each portion of the pillow to add further structural rigidity to the pillow. Pillow-case 20 can be made from any suitable fabric that is comfortable for a person using the pillow, as will occur to those of skill in the art. It will also be apparent that special slip-covers can also be used, which also accommodate the unique features of the pillow and assist in the structural support of the pillow.

Figure 9:
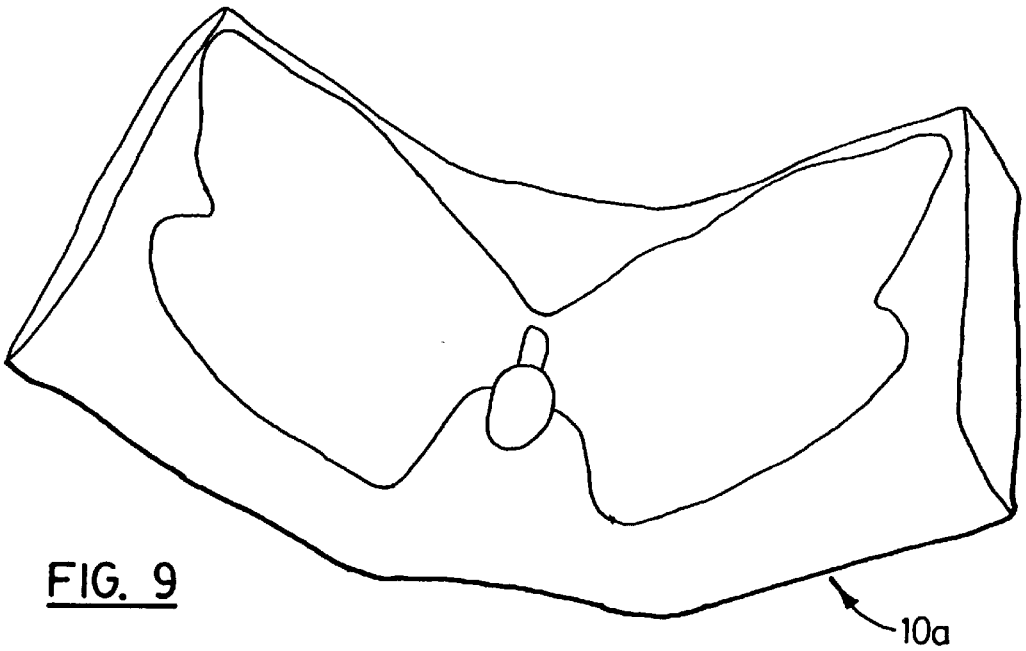
FIG. 9 is a perspective view of a pillow with a butterfly-shape imprinted on it in accordance with another embodiment of the invention.
Figure 10:
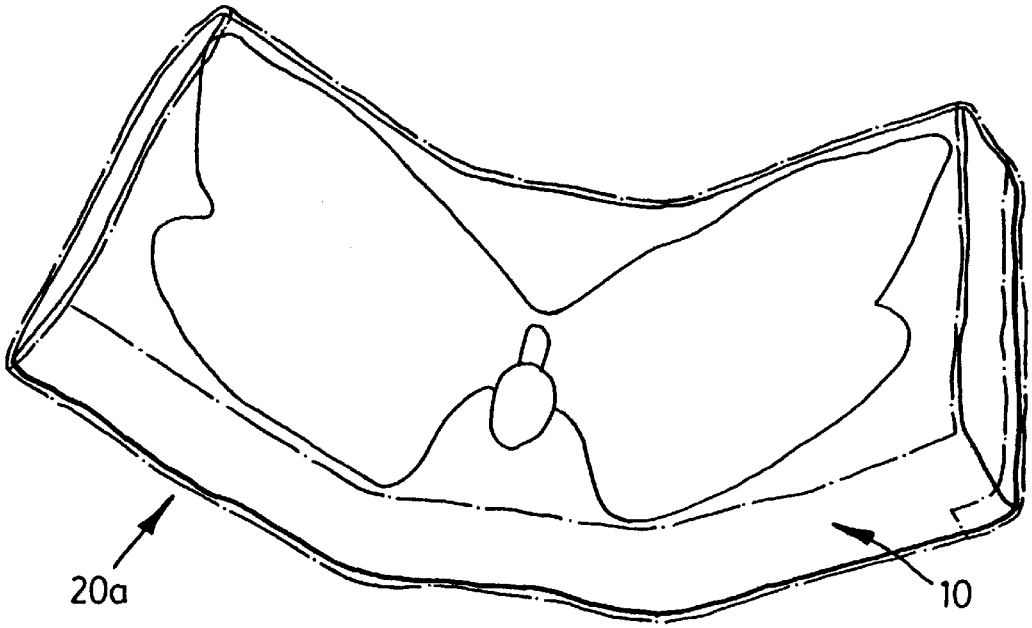
FIG. 10 is a perspective view of the pillow of FIG. 1 encased in a matching pillow case with a butterfly-shape imprinted on the pillow case in accordance with another embodiment of the invention.
Figure 11:
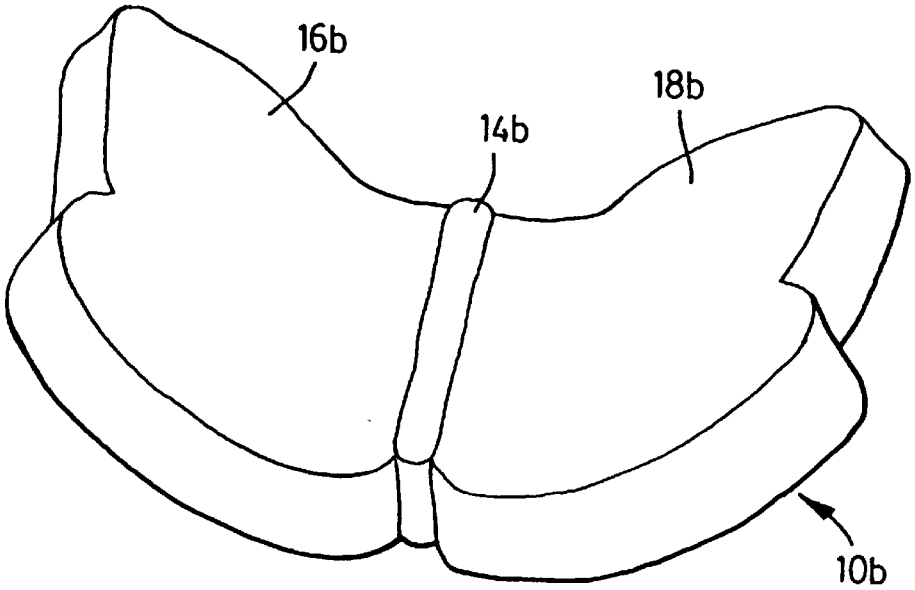
FIG. 11 is a perspective view of a butterfly-shaped pillow in accordance with another embodiment of the invention.

It is further contemplated that pleasing features can be incorporated into the configuration of the pillow-case and/or the pillow itself. A configuration that is pleasing to the child can be incorporated into the instruction of the use of the pillow by using the pleasing configuration to first pique the child's interest in the pillow and then instructing the child in the proper use of the training pillow. For example, a butterfly-shape could be imprinted onto the pillow, as best seen in FIG. 9 and indicated at 10*a* , or imprinted onto a matching pillow-case as best seen in FIG. 10 and indicated at 20*a* The butterfly-shape can also be incorporated into the overall configuration of the pillow as best seen in FIG. 11 and indicated at 10*b*. The thorax of the butterfly can be represented by the base portion 14*b*, while the side portions 16*b*, 18*b* can represent the wings of the butterfly. Other shapes variations and additions are within the scope of the invention.

While only specific combinations of the various features and components of the present invention have been discussed herein, it will be apparent to those of skill in the art that desired subsets of the disclosed features and components and/or alternative combinations of these features and components can be utilized, as desired. For example, while the embodiments discussed herein are directed to pillow 10 having side portions 16, 18 fixed at an angle relative to base portion 14, it is contemplated that pillow 10 can have adjustable side portions 16, 18. It is also contemplated that each portion 14, 16, and 18 can be constructed from different materials and can be joined in a variety of different manners as will occur to those of skill in the art. Further, it is contemplated that each portion can be constructed in layers, for example, having a layer on the convex side with a higher density foam-rubber for improved structural support and a layer on the concave side with lower density foam-rubber for improved comfort. It is also contemplated that pillow 10 can be constructed such that the centre of gravity of pillow 10 will cause pillow 10 to tend to lie in the resting position.

The present invention provides a novel pillow for assisting in training a person not to sleep face-down by providing a pillow with a base portion and two side portions projecting diagonally away from the base portion, such that a person can sleep comfortably on his or her back and/or sides, but will cause discomfort and/or awkwardness when the person tries to sleep face-down, thereby arousing the person into consciousness and reminding the person not to sleep face-down.

I claim:

1. A training pillow for assisting in teaching a person not to sleep face-down, comprising:

a medial base portion for supporting a back of said person's head above a surface, said base portion having opposite ends; and a side portion projecting substantially diagonally from each of said opposite ends of said base portion and away from said surface, such that when said person rolls to one side a corresponding side portion supports a corresponding side of said person's head above said surface, said each of said side portions having an angle from about twenty degrees to about ninety degrees in relation to said base portion and wherein said each of said side portions has different angles in relation to said base portion.

2. The pillow according to claim 1 wherein said each of said side portions has an angle from about thirty degrees to about seventy-five degrees in relation to said base portion.

3. The pillow according to claim 1 where said base portion has at least one fore or aft bulbous portion for supporting a nape of said person's neck adjacent said fore or aft portion, and a recessed portion for supporting said back of said person's head.

4. The pillow according to claim 1 wherein said pillow has a configuration of a butterfly.

5. A training pillow for assisting in teaching a person not to sleep face-down, comprising:

a medial base portion for supporting a back of said person's head above a surface, said base portion having opposite ends; and a side portion projecting substantially diagonally from each of said opposite ends of said base portion and away from said surface, such that when said person rolls to one side a corresponding side portion supports a corresponding side of said person's head above said surface, said each of said side portions having an equal angle of about fifty-seven degrees in relation to said base portion.

6. A training pillow for assisting in teaching a person not to sleep face-down, comprising:

a medial base portion for supporting a back of said person's head above a surface when said pillow is in a resting position, said base portion having opposite ends; and a side portion projecting substantially diagonally from each of said opposite ends of said base portion and away from said surface, said side portions and said base portions forming a concave side for supporting said head and a convex side for abutment with said surface such that when said person rolls to one side said pillow moves from said resting position to a raised position as a corresponding said side portion supports a corresponding side of said person's head above said surface.

7. The pillow according to claim 6 wherein said convex side of said each of said side portions has an angle from about twenty degrees to about ninety degrees in relation to said base portion.

8. The pillow according to claim 6 wherein said convex side of said each of said side portions has an equal angle from about thirty degrees to about seventy-five degrees in relation to said base portion.

9. The pillow according to claim 6 wherein said convex side of said each of said side portions has an equal angle of about fifty-seven degrees in relation to said base portion.

10. The pillow according to claim 7 wherein said convex side of said each of said side portions has different angles in relation to said base portion.

11. The pillow according to claim 6 where said base portion has at least one fore or aft bulbous portions for supporting a nape of said person's neck and a recessed portion for supporting said back of said person's head.

12. The pillow according to claim 6 wherein said side portions are substantially parallelopiped-shaped.

13. A pillow-case for a training pillow for assisting in teaching a person not to sleep face-down, said pillow-case comprising:

a base-sleeve portion for receiving a base portion of a pillow, said base portion having a first end and a second end;

a first side-sleeve portion affixed to said base-sleeve portion and for receiving a first side of said pillow that projects substantially diagonally from said first end; and a second side-sleeve portion affixed to said base-sleeve portion and for receiving a second side of said pillow that projects substantially diagonally from said second end, said sleeve portions being connected such that when said pillow-case is fitted onto said pillow said pillow-case has a concave side and a convex side.

14. The pillow-case according to claim 13 wherein said pillow-case has a configuration of a butterfly.

15. The pillow-case according to claim 13 wherein each of said sleeve-portions are form-fitted to said pillow.

* * * * *